US005624236A

United States Patent [19]

Kubo et al.

[11] Patent Number: 5,624,236

[45] Date of Patent: Apr. 29, 1997

[54] OIL COOLED AIR COMPRESSOR

[75] Inventors: Kazuo Kubo; Koji Akashi, both of Kako-gun, Japan

[73] Assignee: Kabushiki Kaisha Kobe Seiko Sho, Kobe, Japan

[21] Appl. No.: 420,566

[22] Filed: Apr. 12, 1995

[51] Int. Cl.[6] ..... F04B 49/00; F04B 49/10

[52] U.S. Cl. ..... 417/12; 417/18; 417/32

[58] Field of Search ..... 417/12, 18, 32, 417/228; 62/228.1

[56] References Cited

U.S. PATENT DOCUMENTS

| | | | |
|---|---|---|---|
| 3,844,684 | 10/1974 | Kawamura | 417/32 |
| 3,945,464 | 3/1976 | Sato | 184/6.16 |
| 4,358,247 | 11/1982 | Suzuki et al. | 417/32 |
| 4,671,750 | 6/1987 | Miyoshi et al. . | |
| 4,695,233 | 9/1987 | Miyoshi et al. . | |
| 4,812,110 | 3/1989 | Kubo et al. . | |
| 5,072,597 | 12/1991 | Bromley et al. | 62/209 |
| 5,076,067 | 12/1991 | Prenger et al. | 417/32 |
| 5,082,427 | 1/1992 | Fujiwara | 417/32 |
| 5,171,130 | 12/1992 | Kume et al. . | |
| 5,176,505 | 1/1993 | Horii et al. . | |
| 5,199,858 | 4/1993 | Tsuboi et al. . | |
| 5,266,010 | 11/1993 | Tanaka et al. | 417/32 |
| 5,318,151 | 6/1994 | Hood et al. | 184/601 |
| 5,347,821 | 9/1994 | Oltman et al. | 62/84 |

*Primary Examiner*—Timothy Thorpe
*Assistant Examiner*—Xuan M. Thai
*Attorney, Agent, or Firm*—Oblon, Spivak, McClelland, Maier & Neustadt, P.C.

[57] ABSTRACT

An oil-cooled air compressor in which a control unit effects operation of the compressor unit in the condition that a specified period of time has elapsed since the last time the compressor unit was operated for a specified period of time or more at a temperature greater than a specified temperature, to thereby effect dewatering operation of the separator of the compressor only when necessary, resulting in the reduction of wasteful consumption of energy.

1 Claim, 3 Drawing Sheets

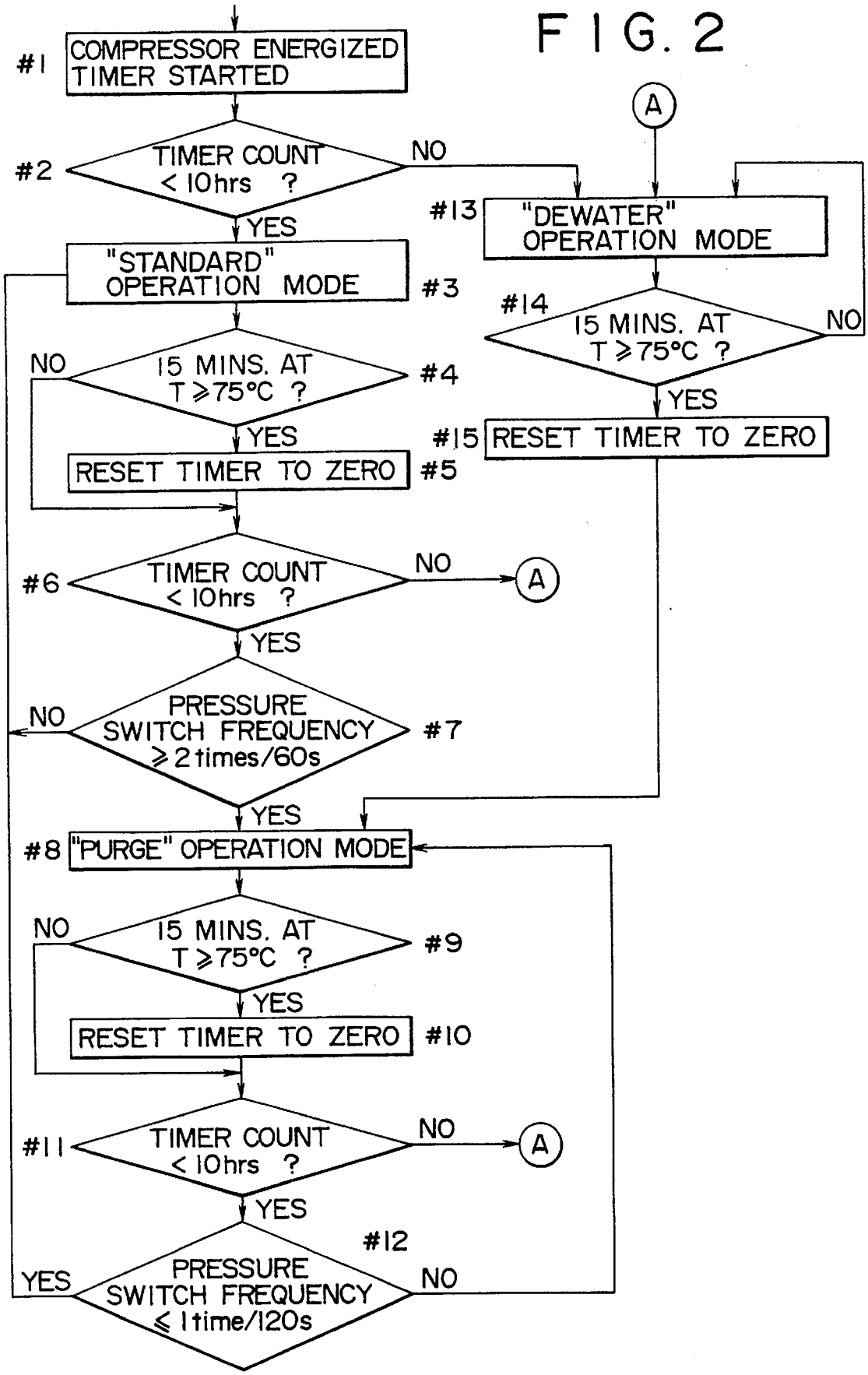
FIG. 2
#1
COMPRESSOR ENERGIZED TIMER STARTED
#2
TIMER COUNT < 10hrs ?
NO
YES
"STANDARD" OPERATION MODE
#3
NO
15 MINS. AT T ≥ 75°C ?
#4
YES
RESET TIMER TO ZERO
#5
#6
TIMER COUNT < 10hrs ?
NO
A
YES
NO
PRESSURE SWITCH FREQUENCY ≥ 2 times/60s
#7
YES
#8
"PURGE" OPERATION MODE
NO
15 MINS. AT T ≥ 75°C ?
#9
YES
RESET TIMER TO ZERO
#10
#11
TIMER COUNT < 10hrs ?
NO
A
YES
#12
YES
PRESSURE SWITCH FREQUENCY ≤ 1 time/120s
NO
A
#13
"DEWATER" OPERATION MODE
#14
15 MINS. AT T ≥ 75°C ?
NO
YES
#15
RESET TIMER TO ZERO

OIL COOLED AIR COMPRESSOR

FIELD OF THE INVENTION

This invention relates to oil-cooled air compressors, for example, an oil-cooled type screw compressors, having a fluid line for the removal of drain water deposited in bottom of the oil separator.

DESCRIPTION OF THE PRIOR ART

FIG. 3 shows a prior art oil-cooled air compressor (Japanese Unexamined Patent Publication Hei 4-228889). An intake line 3 is connected to the inlet port of, and an exit line 5 extends from the exit port of of a compressor unit I. An oil separator 6 is installed in the exit line 5. Furthermore, an oil separator element 7 is installed in the upper part of the oil separator 6, and the lower part of the oil separator 6 comprises an oil collecting section 8. A lubricant oil circulation line 11 connects the oil collecting section 8 to the bearings, shaft sleeve and rotor housing of the compressor unit via oil filter 9 and oil cooler 10. In addition, a water removal line 14 for removing the drain water 12 deposited in the oil collecting section 8, is installed to connect the bottom part of the oil collecting section 8 to the intake port 2 via orifice 13.

Gas is sucked in from intake line via inlet port by the rotors (not shown) rotating inside the compressor unit 1, and compressed together with lubricant oil, for cooling the gas, supplied from lubricant oil circulation line 11, and is expelled to exit line 5 via exit port 4. The compressed gas is then directed with the lubricant oil to oil separator where it is separated the oil by oil separator element 7. The compressed gas is then directed to exit line section 5*a* extending upwards, and the separated oil drops down the oil separator and is collected in the oil collecting section 8 where it is temporarily held. The pressure of the oil collected in the oil separator causes the lubricant oil to flow to various points inside the compressor unit 1 via oil filter 9 and oil cooler 10, where after it is again expelled together with the compressed gas to exit port 4. In the above described way, the lubricant oil is continuously recirculated.

The water component included in the oil collected in the oil collecting section 8 gradually separates from the lubricant oil, and is collected in the bottom most part of the oil collecting section 8. This water is then directed, under the pressure of the lubricant oil collected in the oil collecting section, to intake port 2 (low pressure), its flow controlled by orifice 13 to prevent sudden flow surges. The water is evaporated inside the compressor unit through the heat generated during gas compression and is expelled to exit port 5 as a compressed gas. By effecting the above described kind of operation in which the water separated from the lubricant oil is automatically directed to the intake port 2, there is no need to carry out work on the oil separator to remove water therefrom.

With the above described prior art oil-cooled air compressor, the compressor unit is operated at regular intervals for a specified period of time, specifically and primarily in order to remove any water collected in the oil separator. This "water removal" compressor unit operation is effected regularly without fail, for example, every 10 hours, for a period of for example, 30–40 minutes. However, it is common for the compressor unit to be operated for a similar period of time even during standard operation, with the secondary effect of expelling the water from the oil separator. Accordingly, there will be times when the "water removal" operation is effected even though there is no or very little water collected in the oil separator, resulting in a wasteful and unnecessary use of energy.

SUMMARY OF THE INVENTION

The present invention was made in light of the above problems existing in the prior art compressors and has as its objective the provision of an oil-cooled air compressor in which water removal operation is effected only in cases when drain water has collected inside the oil separator, thus making it possible to reduce wasteful energy use to a minimum.

The present invention provides an oil-cooled air compressor comprising: a compressor unit having an inlet and exit ports; an oil separator connected to the exit port of said compressor unit; a water removal line connecting the bottom of said oil separator to one or more low pressure locations of said compressor unit; a gas release valve connected to the top of said oil separator, a temperature sensor for detecting the temperature of the gas exiting said compressor unit; and a control unit for effecting operation of said compressor unit for a first specified period of time above a specified temperature in the condition that a second specified period of time has elapsed since the last time the compressor unit was operated for a first specified period of time or more at a temperature greater than the specified temperature.

The above described form of control effected by the control unit ensures that operation of the compressor unit primarily in order to achieve the removal of water from the oil separator is only effected when necessary i.e. when there is water collected in the oil separator.

It is preferable that the air compressor also comprises an external humidity sensor and an external temperature sensor for detecting respectively the humidity and temperature of the air outside the compressor, and that said control unit determines a suitable value for said first specified period of time and said specified temperature on the basis of the values detected by said detectors.

BRIEF DESCRIPTION OF THE FIGURES

FIG. 2 is a flow chart showing the procedure used to control the oil cooled air compressor shown in FIG. 1.

DESCRIPTION OF THE EMBODIMENTS

Next, an embodiment of the present invention shall be described with reference to the attached Figures.

Figure 1:
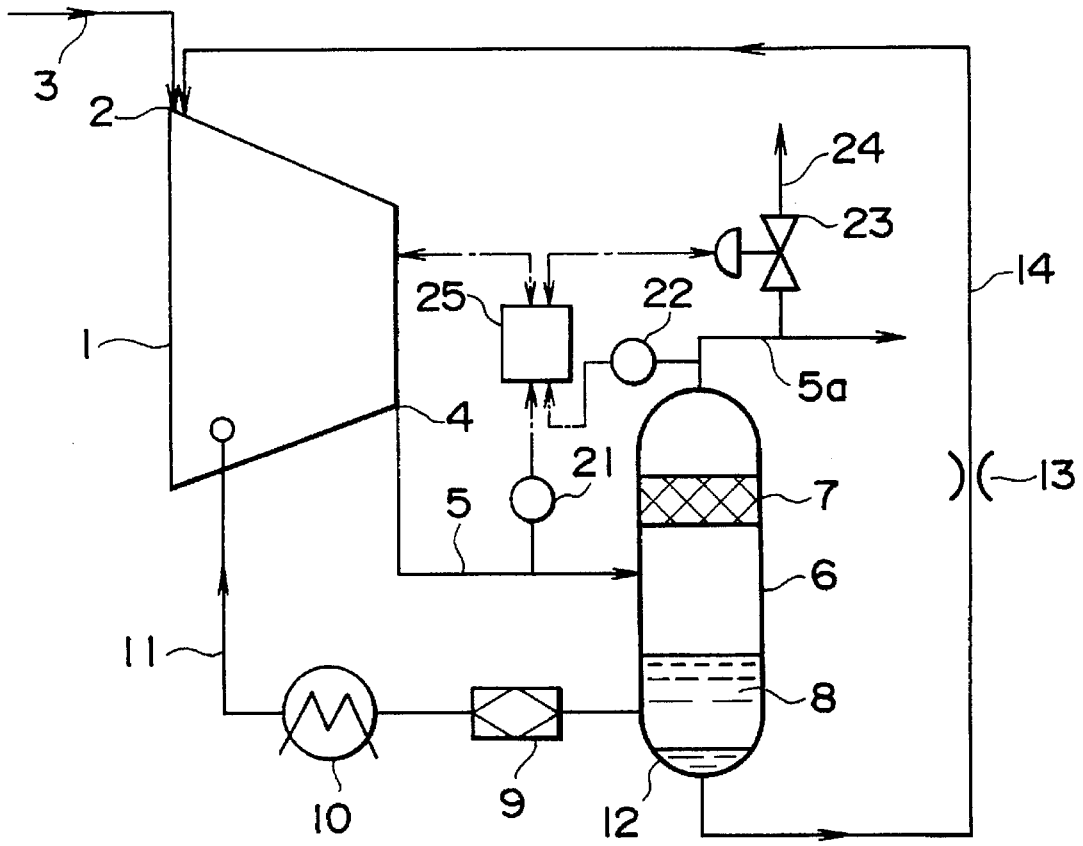
FIG. 1 is a generalized diagram of the structure of an oil-cooled air compressor according to an embodiment of the present invention.
Figure 3:
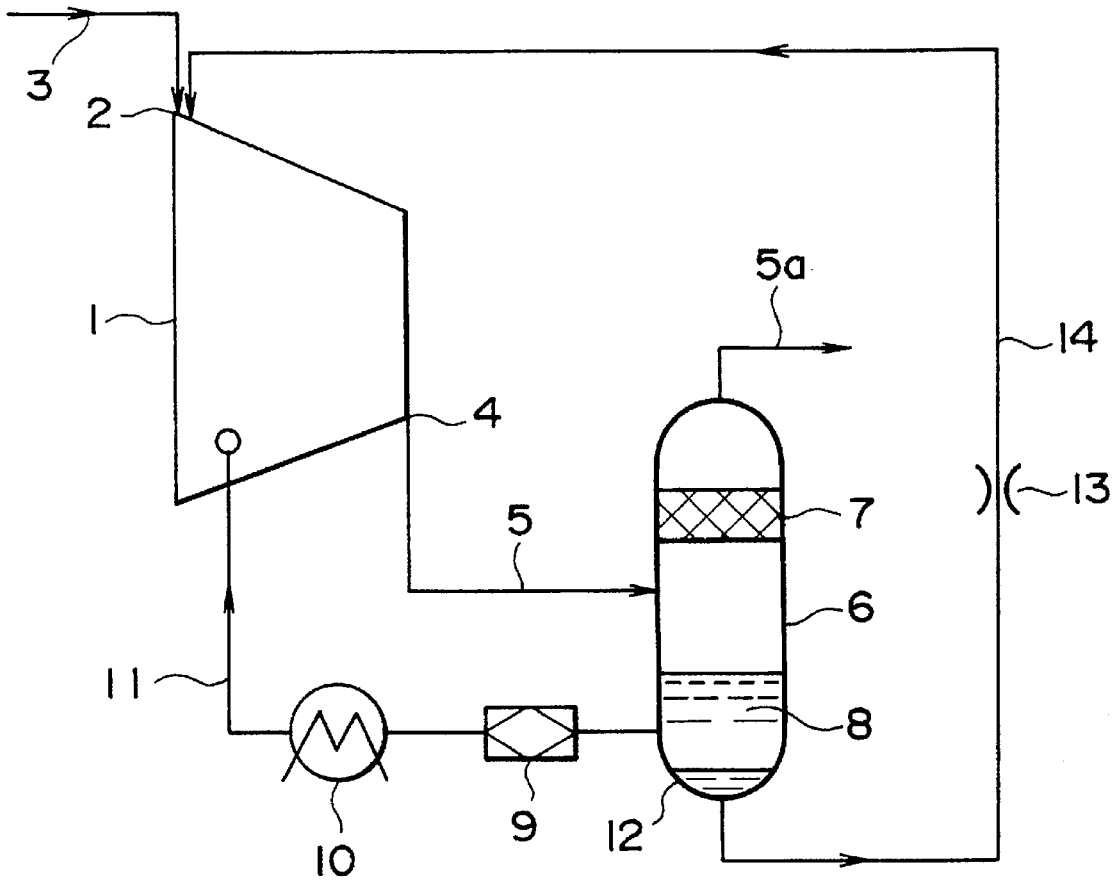
FIG. 3 PRIOR ART
FIG. 3 is a generalized diagram of a prior art oil-cooled air compressor.

FIG. 1 is a generalized view of the structure of an oil-cooled air compressor, for example a screw type air compressor, according to an embodiment of the present invention. Components common with the prior art compressor shown in FIG. 3 are designated with the same reference numbers and a detailed explanation is omitted.

In this embodiment, a temperature sensor 21 and pressure switch 22 for respectively detecting the temperature and pressure of the gas exiting the compressor unit are installed in exit line 5. In addition, a gas release line 24 having a gas release valve 23 installed therein is branched off from exit line section 5*a* located downstream of the oil separator.

Signals communicating the temperature and pressure of the compressed gas exiting the compressor unit, respectively produced by temperature detector 21 and pressure switch 22 are input into control unit 25. Then as shall be explained in detail below, the control of the compressor unit 1 and the release valve 23 is effected by control unit 25 on the basis of the signals received from the temperature detector 21 and pressure switch 22 and a signal from a timer installed inside control unit 25.

Next, the operation of the compressor shall be explained with reference to the flow chart to FIG. 2. In STEP 1 (#1), the compressor is energized and the count of the timer is commenced. In STEP 2 (#2), the count value of the timer is monitored to determine whether it is less than a preset value; in this example the value is set to be 10 hours. If the count value is less than 10 hours ("YES") the procedure moves to STEP 3(#3); if the count value is greater than 10 hours ("NO") the procedure moves to STEP 13(#13).

In STEP 3(#3), the compressor is switched into "standard" operation mode. In this mode, the motor used to drive the compressor unit, is switched on and off in accordance with the demand for compressed air by the user. The demand is determined by detecting the pressure in the line connected to the exit port of the compressor unit. Pressure switch 22 is activated and sends a signal to control unit 25 if the pressure exceeds a preset upper limit, and the control unit stops the motor in accordance with this signal. If the pressure subsequently falls below a preset lower limit, pressure switch 22 is again activated and sends a signal to control unit 25, and control unit 25 starts the motor in accordance with this signal.

In STEP 4(#4), the control unit monitors whether the compressor unit has been operated with the temperature sensor detecting a temperature greater or equal to a specified temperature eg. 75° C. for a specific period of time eg. 15 minutes. If it has ("YES"), the procedure moves to STEP 5(#5). If not ("NO"), the procedure moves to STEP 6(#6).

In STEP 5(#5), the timer count is reset to zero.

In STEP 6(#6), the count value of the timer is monitored to determine whether it is less than a preset value; in this example the value is set to be 10 hours. If the count value is less than 10 hours ("YES") the procedure moves to STEP 7(#7); if the count value is greater than 10 hours ("NO") the procedure moves to STEP 13(#13).

In STEP 7(#7), the frequency with which the motor is stopped and started is monitored. In this example, this is done by monitoring the frequency with which the pressure switch 22 is activated, and if this frequency is equal to once or more in a period of 60 seconds, the procedure moves to STEP 8(#8). If the frequency is less than this upper limit, the procedure moves to STEP 3(#3) and the compressor is maintained in "standard" operation mode.

In STEP 8(#8), the compressor is switched into "purge" operation mode. In "purge" operation mode, the motor and thus the compressor unit is continuously operated and release valve 23 is opened and closed in accordance with the demands for compressed air, i.e. the signals from pressure switch 22. This switch into "purge" mode if the frequency with which the motor is stopped and started exceeds a certain upper limit is effected to prolong the life of the motor. The gas expelled from gas release valve when it is opened is directed to a low pressure location such as the atmosphere or the inlet of the compressor unit.

In STEP 9(#9), the control unit monitors whether the compressor unit has been operated with the temperature sensor detecting a temperature greater or equal to a specified temperature eg. 75° C. for a specific period of time eg. 15 minutes. If it has ("YES"), the procedure moves to STEP 10(#10). If not ("NO"), the procedure moves to STEP 11(#11).

In STEP 10(#10), the timer count is reset to zero.

In STEP 11(#11), the count value of the timer is monitored to determine whether it is less than a present value; in this example the value is set to be 10 hours. If the count value is less than 10 hours ("YES") the procedure moves to STEP 12(#12); if the count value is greater than 10 hours ("NO") the procedure moves to STEP 13(#13).

In STEP 12(#12), the frequency with which the gas release valve is opened and closed is monitored. In this example, this is done by monitoring the frequency with which the pressure switch 22 is activated and if this frequency is less than once in a period of 120 seconds, the procedure moves to STEP 3(#3) i.e. the compressor unit is switched back into "standard" operation mode. If the frequency is greater than once in a period of 120 seconds, the procedure moves to STEP 8(#8) and the compressor is maintained in "purge" operation mode.

In STEP 13(#13), the compressor unit is switched into "dewater" operation mode. This operation mode is essentially similar to "purge" operation mode described earlier.

In STEP 14(#14), the control unit monitors whether the compressor unit has been operated with the temperature sensor detecting a temperature greater or equal to a specified temperature eg. 75° C. for a specific period of time eg. 15 minutes. If it has ("YES"), the procedure moves to STEP 15(#15). If not ("NO"), the procedure moves to STEP 13(#13) i.e. the compressor is maintained in "dewater" operation mode.

In STEP 15(#15), the count of the timer is reset to zero, and the procedure moves to STEP 6(#6).

With the above kind of control, the compressor is continuously operated in one of the three modes; "standard" mode, "purge" mode or "dewater" mode.

This kind of control ensures that the "dewater" mode is only effected when necessary, i.e. when there is water collected in the oil separator thereby reducing unnecessary and wasteful consumption of energy.

The specified temperature and periods of time are preset in the above described embodiment. However, in another embodiment of the present invention, the control unit also receives signals from an external humidity sensor and external temperature detector for detecting respectively the level of humidity and temperature outside of the compressor, and the control unit adjusts the values of the specified temperature and time periods in accordance with the values detected by these detectors.

What is claimed is:

1. An oil-cooled air compressor comprising:

a compressor unit having inlet and exit ports;

an oil separator connected to the exit port of said compressor unit;

a water removal line connecting the bottom of said oil separator to one or more low pressure locations of said compressor unit;

a gas release valve connected to the top of said oil separator;

a temperature sensor for detecting the temperature of the gas exiting said compressor unit;

and a control unit having first means for effecting operation of said compressor based upon a demand and second means for effecting operation of said compressor unit for a specified dewatering period of time above a specified temperature, as measured by said temperature sensor, in the condition that a second specified period of time has elapsed since the last operation of the compressor unit for the specified period of time or more at a temperature greater than the specified temperature dewatering.

* * * * *